United States Patent [19]

Griggs

[11] Patent Number: 4,716,597

[45] Date of Patent: Jan. 5, 1988

[54] NURSING GARMENT

[76] Inventor: Karen M. Griggs, 10440 Magnolia Blvd., North Hollywood, Calif. 91601

[21] Appl. No.: 457,926

[22] Filed: Jan. 14, 1983

[51] Int. Cl.[4] ..... A41D 1/22; A41D 3/08

[52] U.S. Cl. ..... 2/88; 2/106

[58] Field of Search ..... 2/88, 69, 89, 104

[56] References Cited

U.S. PATENT DOCUMENTS

| | | | |
|---|---|---|---|
| 1,131,532 | 3/1915 | McClure | 2/114 |
| 1,599,798 | 9/1926 | Stockton | 2/89 |
| 3,161,887 | 12/1964 | Silver | 2/88 |

FOREIGN PATENT DOCUMENTS

| | | | |
|---|---|---|---|
| 2042756 | 8/1970 | Fed. Rep. of Germany | 2/88 |

*Primary Examiner*—Werner H. Schroeder

*Attorney, Agent, or Firm*—Keith D. Beecher

[57] ABSTRACT

A nursing garment in the form of a loose fitting poncho having an opening at its upper end to enable it to be drawn down over the head of the wearer, and a rigid annular neckpiece in the form of a hoop secured to the fabric of the poncho and surrounding the opening. The poncho is intended to fit loosely over at least the upper portion of the body of the person wearing it, and the neckpiece is intended to fit loosely around the neck of the wearer. The garment provides a simple and inexpensive means for permitting a mother to nurse her baby in public without fear of exposure. Moreover, the neckpiece provides a simple means for enabling the mother to look down into the interior of the garment to observe the baby.

1 Claim, 2 Drawing Figures

NURSING GARMENT

BACKGROUND OF THE INVENTION

Nursing garments are old in the art, but none apparently has been totally commercially acceptable. This is believed to be primarily due to the fact that the prior art nursing garments for the most part were not sufficiently functional, in that they did not provide the wearer with the assurance that when nursing, her breasts would not inadvertently be exposed.

The nursing garment of the present invention is simple, and it is made so that the mother may nurse her baby in an unimpeded and unconstricted manner, and to observe the baby while it is being nursed, all without any possibility that her breasts may be inadvertently exposed. Also, the baby can see the mother through the opening defined by the rigid hoop. The garment also serves to avoid distractions so that the baby may concentrate on nursing.

The garment of the invention is also advantageous in that it provides a covering for the baby while nursing, obviating the need for blankets or other extraneous clothing, the baby being subjected to the mother's body heat and any exposure of the baby to cold external temperatures being avoided. Also, the garment has no tendency to be pulled off the mother, as is the case with blankets.

DETAILED DESCRIPTION OF THE ILLUSTRATED EMBODIMENT

Figure 1:
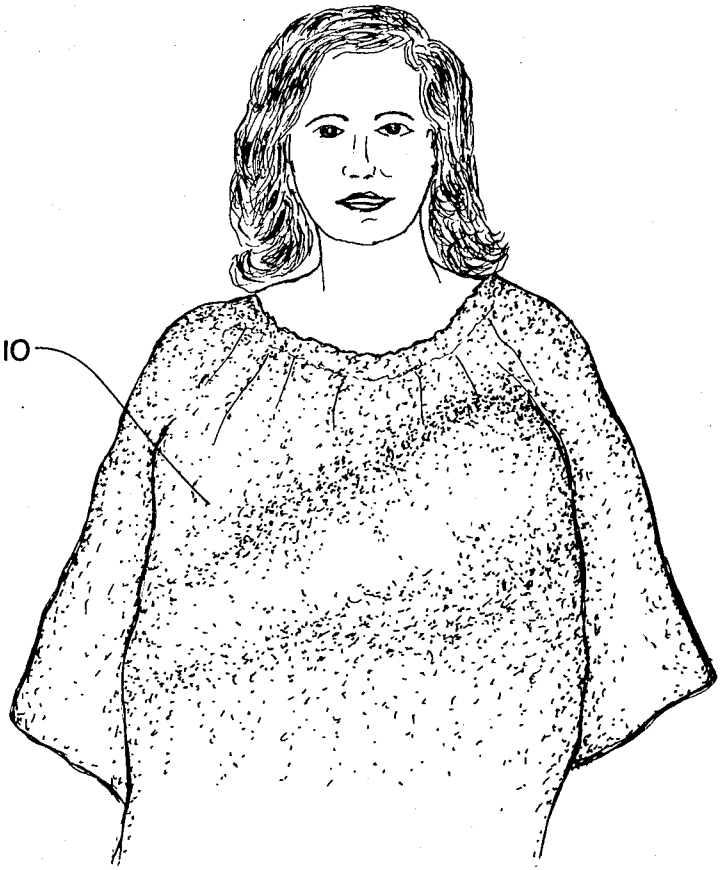
FIG. 1 shows the garment of the present invention as it may be worn normally by a nursing mother.

The garment of the invention is made of an appropriate fabric and has the configuration of a poncho 10 containing no separate arm holes. As shown in FIG. 1, the garment is loose fitting, and it covers the upper portion of the body of the wearer.

Figure 2:
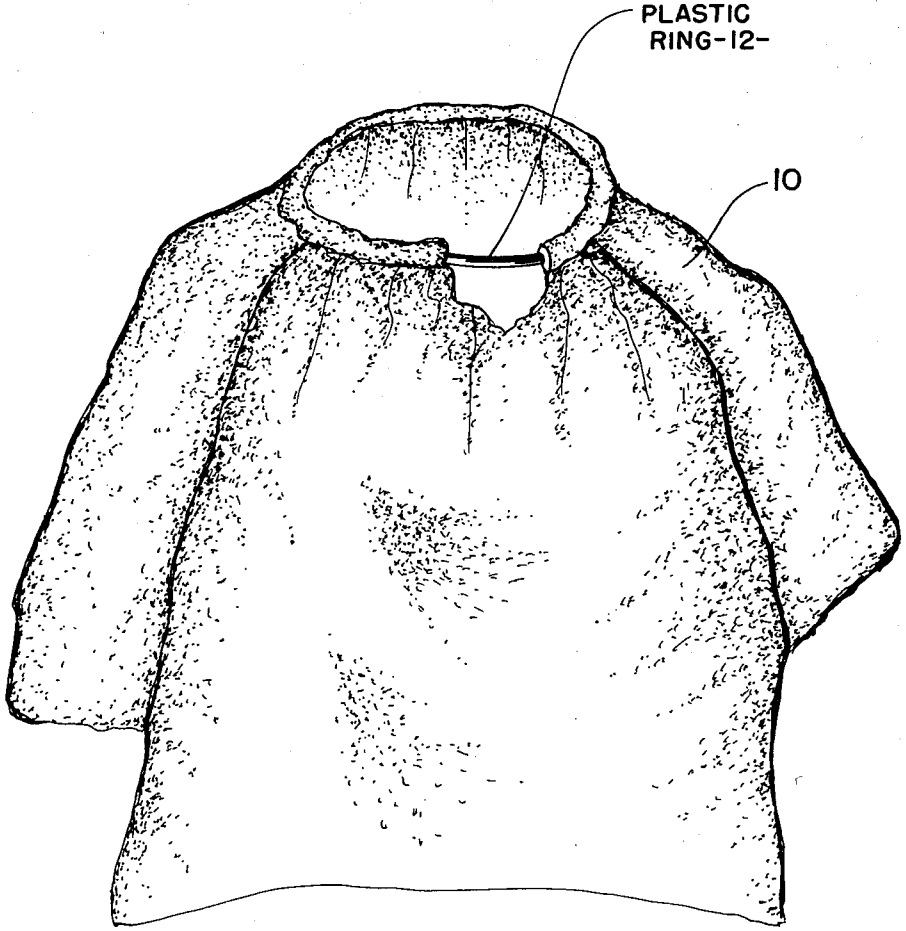
FIG. 2 shows the garment removed from the mother, and partly broken away to reveal a neckpiece in the form of a rigid plastic ring.

The garment has an opening at its upper end for receiving the head of the wearer and for resting on the wearer's shoulders. As shown particularly in FIG. 2, a rigid plastic ring 12 extends around the opening.

The plastic ring has sufficient diameter so that the garment may be drawn down over the head of the wearer, and the ring is also of sufficient diameter so that the mother can move it with her hands, and look down into the interior of the garment to observe the baby, whenever she so desires.

As mentioned above, the garment is so made that there is no chance that the mother's breasts may be inadvertently exposed. Also, the mother is able to nurse her baby in a completely unrestricted and unimpeded manner, and to observe the baby from time-to-time through the rigid neckpiece. Also, the material of the garment may be such that the baby is kept warm, in conjunction with the mother's body heat, so as to obviate any need for blankets, or other external clothing. For summer, extremely light fabric may be used only for preventing exposure, since warmth is not a problem.

It will be appreciated that while a particular embodiment of the invention has been shown and described, modifications may be made, and it is intended in the claim to cover all modifications which come within the true spirit and scope of the invention.

What is claimed is:

1. A nursing garment comprising: a fabric formed as a loose fitting poncho covering at least the upper part of the body of the wearer, said poncho having a circular opening at the upper end thereof to receive the head of the wearer, and an annular rigid neckpiece secured to the poncho and extending around said opening and surrounding the neck of the wearer in a loose fitting relationship and having sufficient diameter to enable the poncho and the neckpiece to be drawn down over the head of the wearer, and said neckpiece having sufficient diameter to permit the wearer to look down into the interior of the garment.

* * * * *